United States Patent [19]

Ershig

[11] Patent Number: 4,871,081

[45] Date of Patent: Oct. 3, 1989

[54] DUAL WALL VESSEL FOR PRIMARY AND SECONDARY LIQUID CONTAINMENT

[75] Inventor: A. Herbert Ershig, Bellingham, Wash.

[73] Assignee: Ershig's, Inc., Bellingham, Wash.

[21] Appl. No.: 262,705

[22] Filed: Oct. 26, 1988

Related U.S. Application Data

[63] Continuation of Ser. No. 148,852, Jan. 27, 1988, abandoned.

[51] Int. Cl.[4] ..... B65D 6/00

[52] U.S. Cl. ..... 220/5 A; 220/1 B; 220/85.5; 220/469; 116/112; 116/DIG. 7

[58] Field of Search ..... 220/1 B, 5 A, 68, 69.1, 220/70.1, 20.5, 445, 469, 85 S; 116/109, 112, DIG. 7

[56] References Cited

U.S. PATENT DOCUMENTS

| | | | |
|---|---|---|---|
| 2,955,723 | 10/1960 | McGrath | 220/20.5 |
| 3,383,004 | 5/1968 | Closner | 220/445 |
| 3,941,272 | 3/1976 | McLaughlin | 220/445 |
| 4,638,920 | 1/1987 | Goodhues, Jr. | 220/85.5 |
| 4,667,701 | 5/1987 | Evans et al. | 220/314 |

FOREIGN PATENT DOCUMENTS

| | | | |
|---|---|---|---|
| 228717 | 12/1962 | Austria | 220/1 B |

*Primary Examiner*—David T. Fidei

*Attorney, Agent, or Firm*—Graybeal, Jensen & Puntigam

[57] ABSTRACT

A containment vessel for potentially harmful fluid including a fluid impermeable primary container having a multi-layer floor including a leak detection system. A concentric secondary fluid impermeable containment vessel surrounds and is spaced from the primary containment vessel and likewise includes a multi-layer floor including a leak detection system.

6 Claims, 1 Drawing Sheet

DUAL WALL VESSEL FOR PRIMARY AND SECONDARY LIQUID CONTAINMENT

This application is a continuation, of application Ser. No. 148,852, filed 1/27/88, now abandoned.

DESCRIPTION

1. Technical Field

This invention relates to a liquid containment vessel and, more particularly, to a primary vessel having a multi-layered sandwich floor including one or more electronic devices for leak detection surrounded by and spaced from a secondary vessel likewise including a multi-layered sandwich floor incorporating one or more leak detection devices. The vessels are secured in spaced relation by shear plates engineered to resist the predicted seismic or other forces to which the tank is likely to be subjected.

2. Background Art

It is well known to construct large waterproof, liquid tight, impermeable containers for containing liquids for bulk storage whether the storage be for future use or for temporary confinement awaiting future treatment.

As we have become more environmentally aware it has become critical that many of these stored liquid substances be, as much as practicable, prevented from accidentally leaking and leeching into the ground, damaging not only the area beneath the container but also the surrounding areas and including ground water, streams and the like.

To this end, considerable effort and research has been expended in an effort to make these structures as leakproof as possible. Further, it is a common practice to install electronic leak detection devices such that if there is a leak it can be detected and repaired at the earliest possible time, minimizing the ecological damage. Although great advances have been made in the ability to construct a container which is essentially leakproof and durable, and substantial progress has been made in incorporating a leak detection system, there is still a considerable amount of concern as to the affect that any leak may have upon the surrounding environment and therefore further security is essential.

DISCLOSURE OF THE INVENTION

With the above noted prior art and concerns in mind, it is an object of the present invention to provide a liquid containment vessel having a primary and secondary shell such that leakage from the primary container, in addition to being detected, will be captured by the secondary vessel which likewise will have a means for detecting any leakage therethrough.

It is another object of the present invention to provide a dual wall vessel which also includes a nonmetallic, corrosion resistant shear plate anchoring system which permits the lateral communication of fluid and yet is designed to withstand seismic forces and the like.

It is yet another object of the present invention to provide a dual wall vessel wherein each of the vessels include a sandwich-type floor including a core permitting lateral fluid communication to assure rapid leak detection.

BEST MODE FOR CARRYING OUT THE INVENTION

Figure 1:
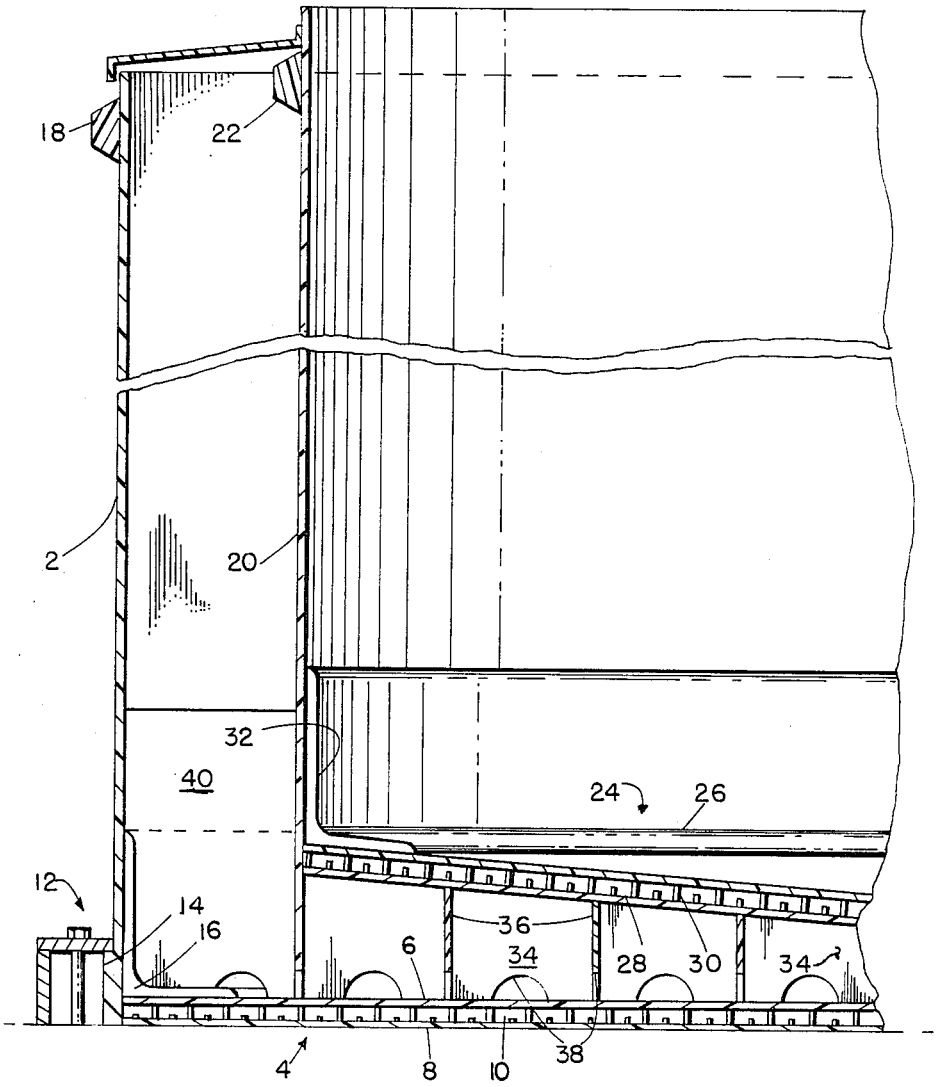
FIG. 1 is a vertical sectional view of the inventive double walled vessel.

As seen in FIG. 1, the inventive double walled primary and secondary liquid containment vessel comprises a continuous fiberglass wound exterior or secondary vessel shell 2 which is sealingly secured to a sandwich floor member 4 having a fluid impermeable inner fiber reinforced plastic sheet 6, a fluid impermeable fiberglass reinforced plastic exterior 8 and an interior vertically oriented grating 10 which is sealingly secured to exterior members 6 and 8, and as described hereinafter, includes kerfs at the lower edge of each of the vertical elements to permit fluid communication therebetween.

As noted above, the floor 4 is sealingly secured to the shell 2 and the combination is held in position upon a prepared foundation or the like by a holddown dog 12 which interacts with an outwardly extending ledge 14 at the lower portion of the shell 2.

The interconnection between the floor 4 and the shell 2 is reinforced by an interior, L-shaped in cross-section, fibre reinforced bridge member or flex knuckle 16 which is secured to the shell 2 and to the floor 4.

The upper portion of the shell will include a fibre reinforced rim stiffener 18 secured to the exterior portion of the shell.

The primary containment vessel or interior wall includes an inner filament wound shell 20 which rests upon and is secured to the outer vessel floor 4 and includes a fibre reinforced stiffener 22 adjacent its upper edge.

A sandwich-type floor 24 which may be flat or concave downwardly likewise includes a fluid impermeable upper element 26, a fluid impermeable lower element 28 and an interior grating 30 which again, as explained hereinafter, includes kerfing on its lower surfaces to permit lateral or horizontal fluid communication.

It is to be noted at this point that both the floor 4 and the floor 24 include integral leak detection devices such that if the inner fluid impervious surface 6 or 24 should fail, a warning will be sounded so that appropriate measures can be taken.

It is to be noted that an L-shaped in cross-section flex knuckle laminate 32 provides the additional strength and sealing between the floor 24 and the shell 20.

The floor 24 is supported at a position above the floor 4 by a grid-like support system made of vertically placed interlocked planar members 34, 36 each of which include a series of semi-circular openings 38 along their lower surface to allow the fluid communication between sections. A semi-circular opening will be located in each wall of a cell formed by the grid formed by members 34, 36.

The inner shell 20 is concentric with the outer shell 2 and is held in position by a plurality of radially extending shear plates 40 which are equally spaced around the vessel.

It is to be understood that typical vessels of the preferred embodiment include an inner vessel or primary containment unit being about 40 feet in diameter whereas the secondary containment or outer vessel is approximately 45 feet in diameter. The outer or lower laminate of the sandwich floor is approximately $\frac{1}{4}$ to $\frac{1}{2}$ inch thick and is bonded to the lower surface of the grating. The grid core, grating or the interior portion of the sandwich is preferably of fiber reinforced plastic approximately 1–2 inches thick and includes as described in detail hereinafter with respect to FIG. 2, a kerfing on the bottom. The upper or inner laminate is approximately ¼ to ½ inch thick and is likewise bonded to the grating such that the floor element, although being of a sandwich having three separate elements is in fact unitary in its final configuration.

The shear plate anchoring system includes the vertical plates 40 which are located radially around the vessel and will preferably be fabricated of a plurality of fiber reinforced plastic plates which connect the upper outer surface of the primary containment shell to the inner surface of the secondary containment shell for the purpose of anchoring the inner shell by transferring moment loading to the anchoring system of the secondary containment shell.

Figure 2:
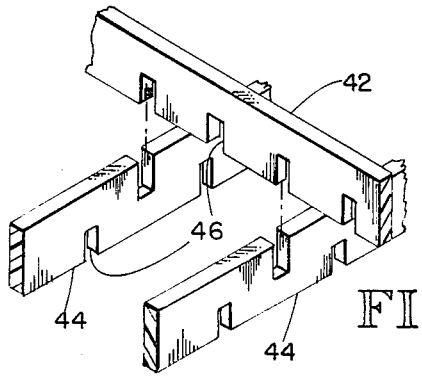
FIG. 2 is an enlarged exploded isometric view of the floor sandwich.

Reference is now had to FIG. 2, wherein the interior grid 10 or 30 of the sandwich floor may be in seen in greater detail and includes interlocking strips 42, 48 including complimentary cuts such that they will interlock and form a grid. Each of the strips include a plurality of downwardly facing kerfs 46 to permit free lateral flow of liquid located therein.

An optional rain shield 48 is shown in FIG. 1.

Thus, as may be seen, the present invention provides a two stage containment system of superior integrity and security. A leak in the primary containment vessel will not only be detected but will also be captured in the secondary containment vessel.

I claim:

1. A double walled vessel for containment of potentially dangerous liquid comprising;

a first, exterior fluid impermeable cylindrical shell;

a first floor of sandwich construction sealingly attached to the first cylindrical shell including a first fluid impermeable sheet secured in spaced relationship to a second fluid impermeable shell with support media located between the sheets secured to both sheets providing uniform support, said support media permitting free flow of liquid between the sheets;

a second, interior fluid impermeable cylindrical shell coaxial with the first cylindrical shell and spaced inwardly therefrom;

a second floor of sandwich construction, sealingly closing the bottom of the second cylindrical shell, said second floor located above the first floor and having a core permitting fluid flow between the exterior fluid impermeable elements;

support means spacedly supporting the second floor, said support means permitting free fluid flow; and leak detection means located in each of the floors.

2. A vessel as in claim 1, wherein the structural elements are of a non-metallic corrosion resistant material.

3. A vessel as in claim 1, wherein the leak detection means is located within the grid of the sandwich floor.

4. A double walled vessel for containment of potentially dangerous liquid comprising;

a first, exterior fluid impermeable cylindrical shell;

a second, interior fluid impermeable cylindrical shell coaxial with the first cylindrical shell and spaced inwardly therefrom;

a floor of sandwich construction sealingly attached to the first and second cylindrical shells including a first fluid impermeable sheet secured in spaced relationship to a second fluid impermeable shell with support media located between the sheets secured to both sheets providing uniform support, said support media permitting free flow of liquid between the sheets;

support means spacedly supporting the second floor, said support means permitting free fluid flow; and leak detection means located at least one of in the floor.

5. A vessel as in claim 4, wherein the structural elements are of a non-metallic corrosion resistant material.

6. A vessel as in claim 4, wherein the leak detection means is located within the grid of the sandwich floor.

* * * * *